United States Patent [19]

Thomas

[11] Patent Number: 4,782,967

[45] Date of Patent: Nov. 8, 1988

[54] MEDICINE VIAL OPENER

[76] Inventor: Robert E. Thomas, 650 Floyd Avenue, Chula Vista, Calif. 92010

[21] Appl. No.: 415

[22] Filed: Jan. 5, 1987

[51] Int. Cl.[4] ..... B65D 41/32

[52] U.S. Cl. ..... 215/231; 206/532; 215/257; 220/279

[58] Field of Search ..... 215/231, 227, 257; 206/532; 220/279

[56] References Cited

U.S. PATENT DOCUMENTS

| | | | |
|---|---|---|---|
| 778,968 | 1/1905 | Herman | 215/257 |
| 2,857,068 | 10/1958 | Kraepelin | 215/231 |
| 2,925,188 | 2/1960 | Grumbles | 215/257 |

*Primary Examiner*—Donald F. Norton
*Attorney, Agent, or Firm*—Charmasson & Holz

[57] ABSTRACT

A system for simultaneously rupturing and carrying away a breakable foil seal and packing from a medicine vial or other container which incorporates a string attached to the foil seal with one end exterior of the foil seal and the other attached to the packing. The exterior end serves as a pull tab or can be attached to another item which serves the same purpose. When pulled, the string first ruptures the foil seal, then carries it away along with the packing. The pull tab may be length of string, additional foil layers of the seal or the vial lid. The system is designed to facilitate access to the contents of the vial by individuals lacking dexterity due to age, illness or amputation.

8 Claims, 1 Drawing Sheet

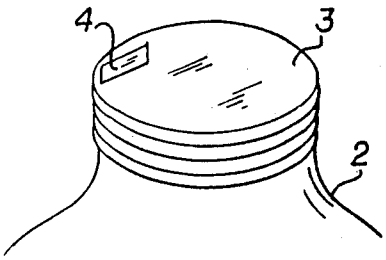
FIG. 1
FIG. 2
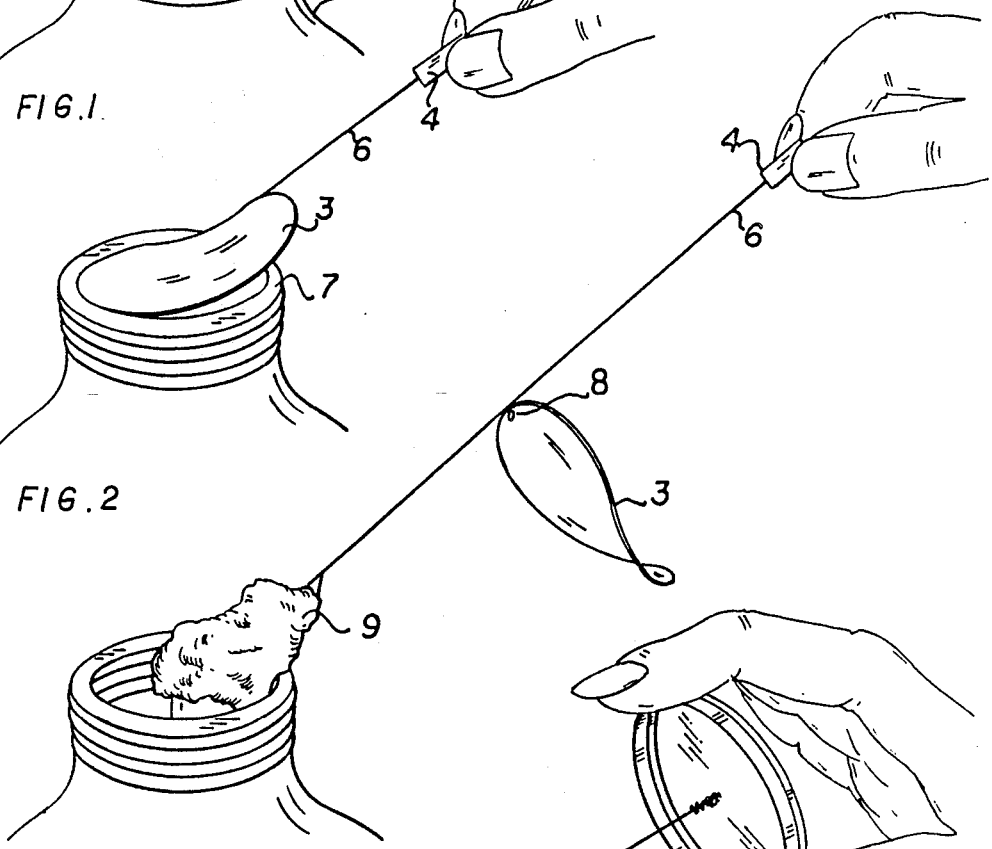
FIG. 3
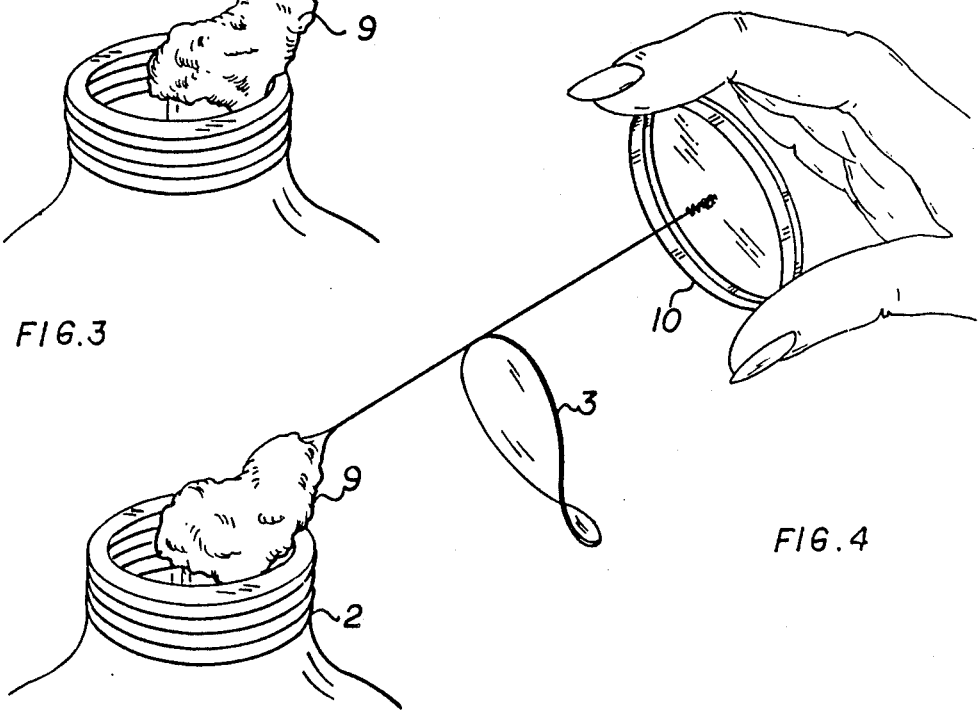
FIG. 4

MEDICINE VIAL OPENER

FIELD OF THE INVENTION

This invention relates to container opening attachments. It also relates more specifically to removal of seals and packing in bottles, jars and medicine vials.

BACKGROUND OF THE INVENTION

Medicine has traditionally been well protected prior to delivery to the end user in order to assure a high quality product. Medicine containers or vials for capsules or pills typically contain a clean packing material, such as cotton, to prevent pills from breakage during transit. More recently, a foil seal has been added which must be broken to gain access to pills, to assure customers that pills were not tampered with if the seal is unbroken. Reclosable cap also seals the vial from dirt or other airborne contamination after the broken foil and packing are disposed of.

However, the breaking of the seal and removal of the cotton packing materials can constitute a very difficult task for persons lacking dexterity—the elderly and those suffering from rhumatoid arthristis. The problem has been addressed in the past, but with limited success.

The prior art to which this invention relates includes: U.S. Pat. Nos. 4,126,245; 2,857,068; 2,091,212; and 2,925,188. Other somewhat related prior art includes: U.S. Pat. Nos. 3,298,555; 3,080,991; and 2,776,067. These patents show some of the elements of this invention. However, the devices described and suggested in the above-mentioned patents do not provide the elements of this invention in a manner which achieves the combined foil rupture, and removal of foil and packing in a single action.

Some of the cited prior art provides flexible tear strings and/or tabs to easily open foil seals. String is placed or glued or heat sealed to the exterior of the foil in a shape to completely or partially remove the foil. This requires cutting the string to length, knotting or attaching a tap if included, preforming string and gluing preformed string onto foil without damaging foil. Tab, if provided, must protrude beyond foil surface. None of the cited prior art provides any connection between foil and packing.

Other cited prior art provides straps, jaws, perforated washers, and apertured discs to attach to the packing. These devices are attached to the bottle cap or are directly pulled or accessible upon removal of cap. Devices also prevent migration of packing during transit. Displacement of cap or device then removes packing. None of these cited prior art would function with a foil seal.

Therefore, in the past, rupture of foil seal, removal of foil seal, and removal of packing have typically required two or three separate actions. Prior art teaches combining rupture and removal of foil, but requires a complex process of attaching a tear string and tab, while still leaving the remaining task of packing removal prior to accessing pills.

SUMMARY OF THE INVENTION

The principal and secondary objects of the invention are:

- to provide a device to rupture foil seal, remove foil and seal and packaging in a single motion requiring little or not dexterity;

- to provide a means to prevent packing from migrating in a foil sealed container;
- to eliminate the need for a sharp object to puncture foil seal; and
- to eliminate the need for a pincer type object to grasp and remove packing.

These and other objects are achieved by providing a filiform member attached to the packing and foil seal of a medicine vial. The filiform member's protruding beyond the foil seal creates a pull tab, or a washer or tab can be attached for greater convenience. In another configuration, the filiform member is attached to the cover of the medicine vial. The filiform member may be chord, foil, string or spring material.

BRIEF DESCRIPTION OF THE DRAWINGS

FIG. 1 is a perspective view of foil sealed medicine vial;

FIG. 2 is a perspective view of foil seal partially broken;

FIG. 3 is a perspective view of foil seal and packing removal.

FIG. 4 is a perspective view of cover attachement.

DESCRIPTION OF THE PREFERRED EMBODIMENT OF THE INVENTION

FIG. 1 shows a perspective view of the top of medicine vial 2. The top is made tamper resistant by adding a foil seal 3. A pull tab 4 protrudes from the foil seal 3. Pull tab 4 also functions as a washer or spacer under the cap (see FIG. 4) of the medicine vial. As a spacer or washer, pull tab could cover the foil seal 3. Pull tab may also be left off.

FIG. 2 shows fingers 5 pulling and extending the pull tab 4. Pulling causes filiform member 6, which was attached to foil seal 3, to rupture foil seal. The portion of filiform member 6 bonded to foil seal 3, is preformed in a circle around the periphery of medicine vial opening 7. Foil seal 3 is shown partially ruptured around the periphery by filiform member 6.

FIG. 3 shows removal of foil seal and packing. A small portion of filiform member 6 remains attached to the ruptured interior 8 of foil seal 3. Continued pulling on pull tab 4 removes the ruptured foil seal 3. Remainder of filiform member 6 is attached to packing 9. Continued pulling on pull tab 4 then removes packing and ruptured foil as shown.

FIG. 4 shows removal of foil seal 3 and packing 9 using cap 10. Instead of pull tab 4, filiform member 6 is attached to cap 10. Removal and pulling cap 10 away from vial 2, ruptures then removes foil seal and packing. After removal, string, foil and packing can be disposed of.

Installation of coiled filiform member and associated components can be accomplished relatively easily using adhesives during cap assembly. Both ends of filiform member are coated with adhesive. Coiled filiform member is placed in vial with one end bonding to the packing. The foil seal, coated with adhesive around periphery, together with a cardboard spacer and cap are placed over the opening. The exposed end of the coiled filiform member penetrates the foil seal and bonds to the spacer. In an alternate configuration without a spacer, coilded filiform member bonds to the cap.

Although this invention has been described in its preferred and alternate embodiments, it is clear that other embodiments and modifications can be devised by those skilled in the art without exercise of inventive faculty and within the spirit of the invention as well as the scope of the appended claims.

What is claimed is:

1. In combination with medicine vial for pills, capsules or the like where a resilient packing material is inserted below in the neck of the vial to immobilize its contents and a closure assembly which comprises:

a foil seal adhesively bonded to the rim of the vial opening;

a filiform member having a first length running under a portion of said seal, and a second length protruding above said seal;

means for attaching one end of said first length of filiform member to said packing material; and means for pulling the end of said second length of filiform member, above said foil seal and container, wherein said first length is positioned and bonded to said portion so that the filiform element when pulled rupture said foil seal and extracts the packing material from the vial.

2. The combination as claimed in claim 1, wherein said first length of filiform member is bonded under the periphery of one said foil seal.

3. The combination claimed in claim 1, wherein said means for attaching the filiform member to the packing material consists of adhesively coating one end of said filiform member and contacting said packing with said coated end.

4. The combination claimed in claim 1, wherein said means for attaching said filiform member to the packing consists in looping one end of the filiform member around said packing.

5. The combination claimed in claim 1, wherein said means for pulling said filiform member consists of a knotted portion of said filiform member exterior of said foil seal.

6. The combination claimed in claim 1, wherein said means for pulling said filiform member consists of a tab attached to the end of said member on the exterior of said foil seal.

7. The combination claimed in claim 1, wherein said means for pulling said filiform member consists of a disc washer attached to the end of said member on the exterior of said foil seal.

8. The combination claimed in claim 1, wherein said means for pulling said filiform member consists of a lid for said vial having its underside attached to the end of said member on the exterior of said foil seal.

* * * * *